US006003443A

United States Patent [19]

Kubsik et al.

[11] Patent Number: 6,003,443

[45] Date of Patent: Dec. 21, 1999

[54] METHOD AND APPARATUS FOR REDUCING NOISE GENERATED BY THE ACCUMULATION OF CARRIERS IN A CONVEYOR SYSTEM

[75] Inventors: Robert H. Kubsik, W. Bloomfield; Clayton C. McDonald, Howell, both of Mich.

[73] Assignee: Jervis B. Webb Company, Farmington Hills, Mich.

[21] Appl. No.: 08/998,646

[22] Filed: Dec. 29, 1997

[51] Int. Cl.[6] ..... B61B 3/00

[52] U.S. Cl. ..... 104/172.4; 104/89; 104/93; 105/148; 105/150; 213/220; 213/221

[58] Field of Search ..... 104/89, 93, 94, 104/95, 172.4; 105/148, 150, 154, 155; 213/220, 221

[56] References Cited

U.S. PATENT DOCUMENTS

| | | | |
|---|---|---|---|
| 3,011,457 | 12/1961 | Peras . | |
| 3,083,650 | 4/1963 | Peras . | |
| 3,284,122 | 11/1966 | Rich | 213/220 |
| 3,294,254 | 12/1966 | De Ment . | |
| 3,467,023 | 9/1969 | Dodds et al. . | |
| 3,664,267 | 5/1972 | Di Rosa | 104/172.4 |
| 3,721,433 | 3/1973 | Sobel | 213/221 |
| 3,726,234 | 4/1973 | Dema et al. | 104/172.4 |
| 3,818,840 | 6/1974 | Dehne | 104/172.4 |
| 3,876,082 | 4/1975 | Fehl et al. | 213/221 |
| 4,058,064 | 11/1977 | Wilder et al. . | |

FOREIGN PATENT DOCUMENTS

| | | | |
|---|---|---|---|
| 2292131 | 2/1996 | United Kingdom | B16B 10/00 |

*Primary Examiner*—Robert J. Oberleitner
*Assistant Examiner*—Robert J. McCarry, Jr.
*Attorney, Agent, or Firm*—Dickinson Wright PLLC

[57] ABSTRACT

An apparatus and method for reducing the noise generated by colliding conveyor carriers is disclosed which comprises urethane bumpers and a method of attaching same to portions of the carriers that do not make contact with other carriers when the carriers are accumulated. The bumpers extend from the carriers a sufficient distance to contact a similar bumper on an adjacent carrier when one carrier rolls up against another. The bumpers do not prevent the normally contacting portions of the carriers from coming into contact, but merely absorb a portion of the kinetic energy of the moving carrier to reduce the noise generated when the contacting portions of the trolleys do meet, and the presence of these bumpers does not adversely affect the spacing of the carriers in the accumulation line.

17 Claims, 2 Drawing Sheets

METHOD AND APPARATUS FOR REDUCING NOISE GENERATED BY THE ACCUMULATION OF CARRIERS IN A CONVEYOR SYSTEM

The present invention is directed to a method and apparatus for reducing the noise caused by carriers impacting against one another in the accumulation portion of a conveyor line, and more specifically to a method and apparatus for reducing the noise caused by carrier impacts without significantly altering the spacing between the carriers in the accumulation line.

BACKGROUND OF THE INVENTION

Power and free conveyors are well known systems made up of a power track and a free track and a pair of trolleys capable of traveling along the free track and supporting a carrier. Each leading trolley in a power and free system includes a driving dog portion which extends toward the power track and which is engageable by a pusher dog carried by a moving chain on the power track. When the pusher dog and the driving dog are engaged, the trolley is pushed along the free track by the moving power chain. When the driving dog is retracted, or otherwise disengaged from the pusher dog, the trolley stops moving.

Power and free conveyors often include accumulation tracks or sections where a number of carriers can be stored in a closely spaced or contacting relationship out of the way of the main portion of the conveyor system until they are needed. In order to accumulate carriers, it is necessary to disengage the driving dogs of the trolleys supporting the carriers from the pusher dog. This is usually accomplished by having the accumulation section of the track at a different elevation than the main portion of the track so that a carrier directed into the accumulation portion will roll down and away from the pusher until it runs into a stationary object The slope must be steep enough to ensure that the carrier moves quickly away from the pusher to avoid jams and to impart a sufficiently high speed to the carrier to ensure that it continues to roll along the accumulation section of track until it contacts a stop or another carrier. Additional carriers can be accumulated in this manner until the accumulation section of track is full. However, because carriers are periodically removed from the downstream end of the accumulation section, new carriers can be continuously accumulated.

Trolleys and carriers are made of steel or similar alloys and consequently are quite heavy. Each pair of trolleys supports a carrier which is also very massive and which may be supporting a heavy workpiece at any given time. Such carriers possess large kinetic energies when they roll along the accumulation section of the conveyor track, and this energy must be dissipated in order to stop the carrier. Because the carriers and trolleys are made from metal, a significant amount of energy from each collision between carriers is dissipated as sound waves, and each impact produces a relatively loud noise. Since a given conveyor line may have multiple accumulation portions, and a plant may have multiple conveyor lines each equipped with multiple accumulators, the noise produced by the accumulation of carriers is substantial and frequent. This noise can be unpleasant to anyone in a plant where accumulators are used, and, to employees required to work in close proximity to these accumulators, the noise can have adverse health affects as well.

The high frequencies generated by this metal-to-metal contact can be particularly damaging to hearing. In addition, the trolleys are often not accumulated at regular intervals. Thus, the sound of each successive impact may come as something of a surprise to nearby employees. An employee who is startled by such sudden noises may have difficulty concentrating on his job. Attempts have been made, therefore, to reduce the noise created by these accumulations. The normal solution is to coat the metal surfaces normally making contact with rubber or a similar material which will absorb the impact of the collisions. While this can reduce the noise problem to some extent, it also increases the spacing between adjacent carriers in an accumulation line, especially when enough cushioning material is used to reduce the noise level by a noticeable amount. This increased spacing changes the location of each trolley in the accumulation line and makes it difficult for a system controller to keep track of the carriers. In addition, this altered spacing may prevent the carriers from aligning properly with other elements of the conveyor system, such as unloading platforms along the accumulation track. In addition, adding these materials to existing systems usually requires that the trolleys be modified to accommodate the cushioning. This is often cost prohibitive. It would therefore be desirable to reduce the noise generated by the accumulation of carriers in a conveyor line without adversely affecting the spacing of the carriers, and which noise reduction could be employed on existing systems without extensively modifying the carriers.

SUMMARY OF THE INVENTION

These and other problems are addressed by the present invention which comprises an improved conveyor carrier having a number of resilient bumpers attached to portions of the carriers that do not make contact with other carriers when the carriers are accumulated. The bumpers are configured so that they make contact with one another before the metal contact surfaces of the carriers collide. The bumpers can be made sufficiently large to absorb a large portion of the force of impact between carriers, yet their positioning away from the normally contacting surfaces prevents them from adding significantly to the spacing between carriers in an accumulation line. In addition, the bumpers are preferably made from a somewhat resilient material so that the sound generated by their impact is quieter and at a lower frequency than the sound generated by a metal-to-metal impact. It has been found that the noise caused by the accumulation of carriers can be reduced to an acceptable level in this manner and that it is not necessary to eliminate metal-to-metal contact completely.

In a preferred embodiment, the bumpers are made from urethane and can be retrofitted to existing carriers by bolting them to the openings on the trolleys normally used to connect the support platform of the carrier to the trolleys. The bumpers include an attachment portion which fits between two spaced-apart walls on existing trolleys. A bore is provided in the attachment portion which is aligned with existing bores in the trolley, and a bolt is passed through these aligned openings to hold the bumper in place. The bumpers also include a main body portion, much of which is disposed above or below the trolley body. The bumpers are sized so that they make contact before any other portions of the trolleys make contact and absorb a portion of the energy of impact. By attaching these bumpers to portions of the trolleys that do not normally make contact, significant noise reduction can be achieved without adversely affecting the intertrolley spacing.

It is therefore a primary object of the present invention to provide a method and apparatus for reducing the noise produced when two objects collide.

It is another object of the present invention to provide a method and apparatus for reducing the noise produced by the accumulation of carriers in a conveyor line.

It is a further object of the present invention to provide a bumper for absorbing some of the force of a moving carrier as it impacts against another object.

It is yet another object of the present invention to reduce the noise generated by colliding carriers while not significantly changing the spacing between the carriers.

It is yet a further object of the present invention to provide a method for reducing the amount of high frequency noise generated by the collision of two metal objects.

It is still another object of the present invention to provide a method for mounting bumpers on conveyor carriers which reduces the noise generated by the accumulation of the carriers without significantly increasing the spacing between the carriers in an accumulation line.

BRIEF DESCRIPTION OF THE DRAWINGS

These and other objects of the present invention will become apparent from a reading and understanding of the following detailed description of a preferred embodiment together with the following drawings of which.

DETAILED DESCRIPTION OF THE PREFERRED EMBODIMENT

Figure 1:
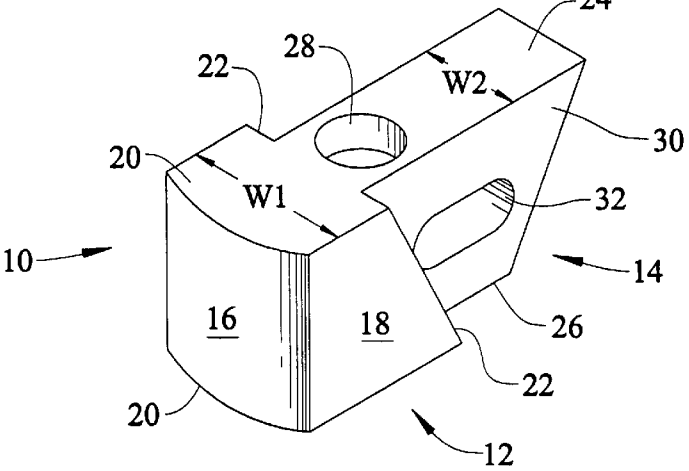
FIG. 1 is a pictorial view of a trolley bumper according to the present invention.

Referring now to the drawings, wherein the showings are for the purpose of illustrating a preferred embodiment of the present invention only and not for the purpose of limiting same, FIG. 1 shows a bumper 10 having a main body portion 12 with a width W1 and an attachment portion 14 with a width W2 formed from a single piece of material, preferably urethane. Main body portion 12 includes an outwardly bowed front contacting wall 16, parallel side walls 18, parallel top and bottom walls 20 and a rear wall 22 normal to side walls 18 and angled with respect to front wall 16. The angle of rear wall 22 with respect to the side walls gives each of the side walls 18 a trapezoidal shape. Attachment portion 14 projects from the central portion of rear wall 22 and includes a top wall 24 and a parallel bottom wall 26 which walls extend continuously from top and bottom walls 20 of main body portion 12. Top wall 24 includes a blind bore 28 located above and extending toward rear wall 22 of main body portion 12. Attachment portion 14 further includes parallel side walls 30 perpendicular to top wall 24 and a bore 32 extending through portion 14 between these side walls. Width W2 of attachment portion 14 is less than width W1 of main body portion 12 and therefore sections of main body portion rear wall 22 are exposed on either side of attachment portion 14.

Figure 2:
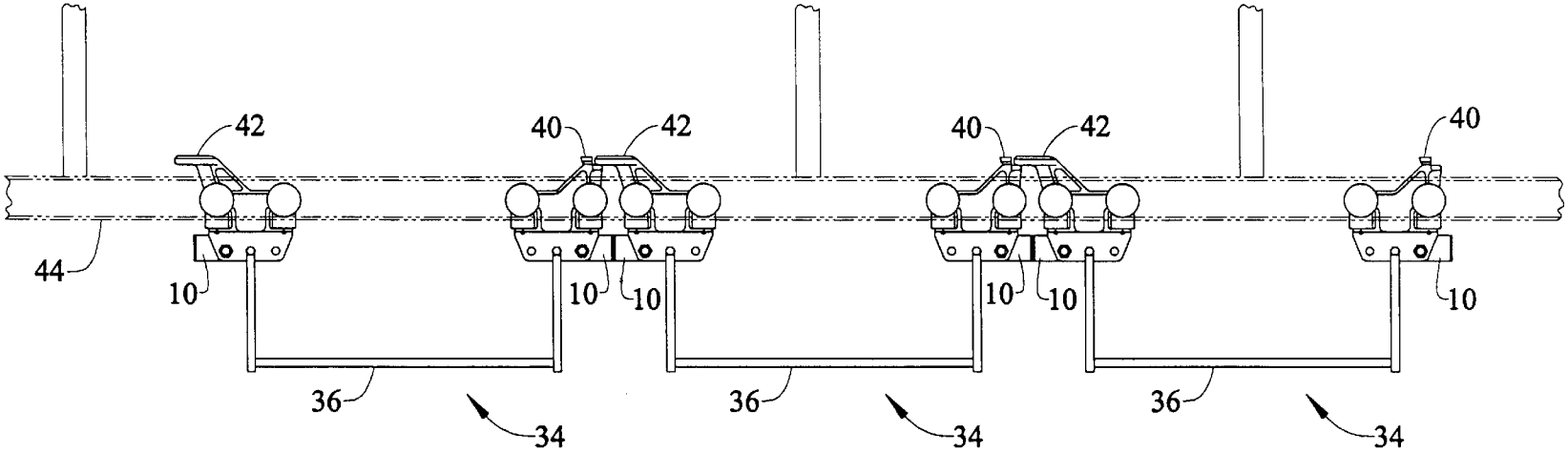
FIG. 2 is a side elevational view of a number of carriers in an accumulation line equipped with the bumpers shown in FIG. 1; and, FIG. 3 is a side elevational detail view, partly in section, of two of the trolleys shown in FIG. 2.
Figure 3:
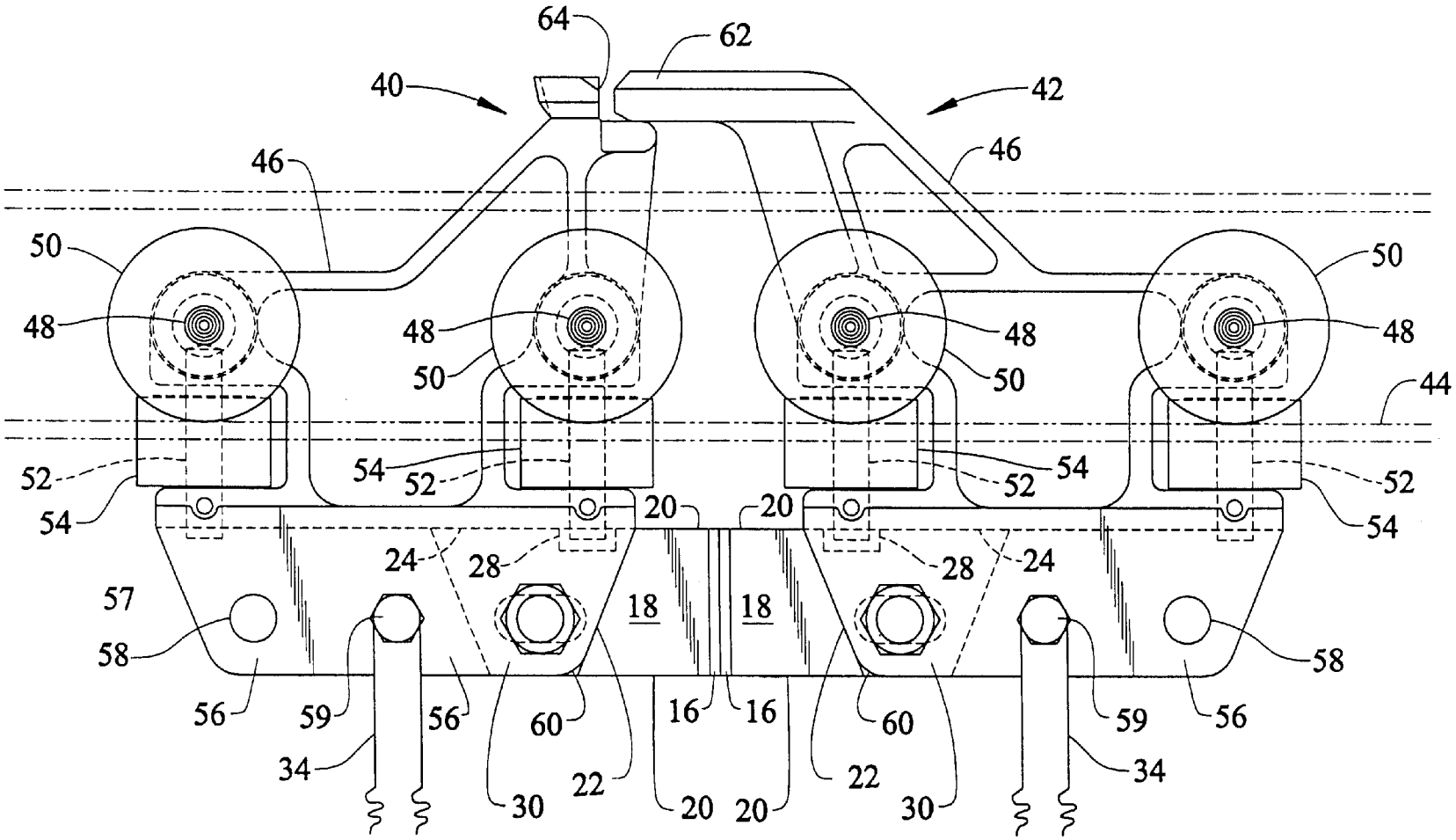

FIG. 2 shows a number of carriers 34 comprising support platforms 36, trailing trolleys 42 and leading trolleys 40. The trolleys are equipped with bumpers 10 and are supported for rolling movement on a track 44. The leading and trailing trolleys have many identical parts and the same reference numerals will be used to identify parts common to both carriers. As best seen in FIG. 3, the trolleys each comprise a body 46 to which support wheel axles 48 are attached for holding support wheels 50 and to which guide wheel axles 52 are attached for holding guide wheels 54. Each trolley 40, 42 further includes parallel spaced apart flanges 56 depending from the undersides of the trolleys for supporting platforms 36. Flanges 56 of each trolley are spaced apart by a gap 57 and each flange 56 includes several openings 58 aligned with similar openings in the opposite flange 56 for receiving a bolt 59 to attach the support platforms to the trolley. Flanges 56 include front and rear ends 60 which do not come into contact with other trolleys when the trolleys are accumulated in a line.

Trailing trolley 42 includes a wing 62 extending rearwardly from the top portion of body 46, and leading trolley 40 includes a contact wall 64 at the top portion of body 46. Wing 62 and contact wall 64 are the contacting portions of the trolleys, and it is these portions of the trolleys that normally make contact when the carriers are accumulated. The trolley bodies 46, including wing 62 and contact wall 64, are made of metal and thus a load noise is generated when these portions of the trolleys collide.

A bumper 10 is attached to the rear portion of each trailing trolley and the forward portion of each leading trolley by inserting attachment portion 14 into gap 57 flanges 56 so that the bore 32 on the bumper is aligned with one of the openings 58 in flanges 56. A bolt 66 is then passed through these aligned openings and secured to flange 56 with a nut 68. The bumper is held in place by the tight fit between the spaced apart flanges as well as by the compressive force of the nut and bolt combination. Guide wheel axle 52 which extends downwardly into gap 57 is accommodated by blind bore 28 in top wall 24 of the bumper. Rear wall 22 of the bumper is angled at an angle supplementary to the angle of ends 60 so that bottom walls 20 and 26 of the bumper are aligned with the bottom portion of walls 56 and so that front wall 16 of the bumper is generally perpendicular to track 44. The distance between rear wall 22 and front wall 16 of the bumper is chosen such that when the bumpers of two adjacent trolleys are at rest and in contact with one another, wing 62 and contact wall 64 are separated by a distance of about one half inch, more preferably by about one quarter inch, and ideally by about one eighth of an inch.

This spacing is not sufficient to prevent contact between wing 62 and wall 64 when a carrier is accumulated. Instead, when one carrier makes contact with another, wall 16 of bumper 10 on the moving trolley comes into contact with wall 16 of bumper 10 on the stationary trolley and the bumpers are compressed by the force of the moving carrier until wall 64 collides with wing 62 to stop the carrier. The impact of the urethane bumpers against one another generates less noise than the impact of metal against metal because much of the energy of impact is absorbed by the deformation of the urethane bodies instead of being converted into sound waves. The sound produced is also at a lower frequency and thus is not as penetrating as the sound of metal on metal. The compression of the bumpers absorbs a sufficient amount of energy so that when wing 62 and wall 64 finally meet, wall 64 is traveling at a lower speed than it would have been absent the bumpers and consequently the impact produces a much softer sound. After impact, the urethane bumpers return to their original shapes which separates wing 62 from wall 64. The spacing between the wing and the wall, however, is quite small, preferably on the order of one eighth of an inch. The eighth carrier in an accumulation line where these bumpers are used, for example, will only be out of place by one inch as compared to the eighth carrier in a line of carriers which do not include bumpers. This small spacing does not adversely affect the monitoring of the carriers or the control of the system.

The present invention has been described in terms of a preferred embodiment, it being understood that numerous modifications of the subject bumper and carrier will become apparent to those skilled in the art upon a reading and understanding of the foregoing description. For example, the shape of the bumper could easily be altered to allow it to be attached to a trolley of a different design and the bumpers could be attached at other locations on the trolleys or even on the carriers without exceeding the scope of this invention. It is intended that all such changes and modifications be included in this invention to the extent that they are described by the several claims appended hereto.

We claim:

1. A conveyor system comprising a support track, a first carrier supported on said support track by a leading trolley and a trailing trolley, a second carrier supported on said support track downstream from said first carrier by a leading trolley and a trailing trolley, wherein each of said leading trolleys including a front contacting planar stop surface, and each of said trailing trolleys including a rear contacting planar stop surface, said front contacting planar stop surface of a second carrier leading trolley facing the rear contacting planar stop surface of a first carrier trailing trolley, a front bumper connected to said second carrier leading trolley and having a front contacting face; and, a rear bumper connected to said first carrier trailing trolley and having a rear contacting face;

wherein the planar stops surfaces are spaced apart a distance when the front and rear contacting faces initial contact each other.

2. The conveyor system of claim 1 wherein the distance between the front and rear stop surfaces is about one half inch.

3. The conveyor system of claim 1 wherein the distance between the front and rear stop surfaces is about one quarter inch.

4. The conveyor system of claim 1 wherein the distance between the front and rear stop surfaces is about one eighth inch.

5. The conveyor of claim 1 wherein each of said bumpers are resilient.

6. The conveyor of claim 5 wherein each of said bumpers are comprised of urethane.

7. The conveyor of claim 6 wherein each of said bumpers includes a first face conforming to a surface of said trolley.

8. The conveyor of claim 1 wherein said bumpers are compressible to allow contact between said second carrier leading trolley contacting surface and said first carrier trailing trolley contacting surface when said second carrier collides with said first carrier.

9. The conveyor of claim 1 wherein said front bumper comprises:

a main body portion having a top wall, a bottom wall spaced apart from and parallel to said top wall, first and second parallel side walls extending between said top wall and said bottom wall, a front wall connected between said side walls and said top and bottom walls, and a rear wall normal to said side walls and angled with respect to said front wall; and an attachment portion having (i) parallel top and bottom walls contiguous with said main body portion top wall and bottom wall, (ii) parallel spaced apart side walls extending from the main body portion rear wall and between said attachment portion top and bottom walls, and spaced inwardly of the first and second parallel side walls of the main body portion, and (iii) a bore extending through said attachment portion between said parallel and spaced apart side walls, an axis of said bore generally parallel to the rear wall of the main body portion.

10. The conveyor of claim 9 wherein said front and rear bumpers are comprised of urethane.

11. A method for reducing noise generated in a conveyor system by the accumulation of carriers having planar-contacting surfaces while maintaining a close spacing between the contacting surfaces of the carriers, the planar contacting surfaces of adjacent carriers facing each other, the method comprising the steps of:

a) mounting bumpers on surfaces of said carriers;

b) propelling one carrier into a downstream carrier;

c) reducing noise generated when the bumper of the one carrier strikes the bumper of the downstream carrier before the facing planar-contacting surfaces collide; and d) accumulating the one carrier with the downstream carrier with a space between the facing planar-contacting surfaces.

12. The method of claim 11 wherein the step of mounting bumpers comprises the steps of inserting a portion of said bumper into a space on an existing trolley and passing a bolt through an existing opening in said trolley and an opening in said portion.

13. A conveyor system comprising a support track, and a first trolley and a second trolley supported on said support track for movement therealong, wherein said trolleys each include at least one metallic contacting surface and at least one resilient contacting surface, the resilient contacting surfaces extending from a portion of each trolley such that said metallic contacting surfaces of said first and second trolleys contact one another only after said resilient contacting surface of said second trolley has contacted said resilient contacting surface of the first trolley, the metallic contacting surfaces being spaced from each other after contact and when the trolleys are at rest as a result of the sizing of the resilient contact surfaces of each trolley.

14. The conveyor system of claim 13 comprising a bumper mounted on each trolley, each bumper having the resilient contacting surface.

15. The conveyor of claim 14 wherein each bumper extends from each respective trolley a distance to ensure that contact between the resilient contacting surfaces of the respective trolleys occurs prior to contact between the metallic contacting surfaces of the respective trolleys.

16. The conveyor system of claim 1 comprising:

an accumulation track connected to said support track for accumulating a plurality of carriers in a closely spaced relationship;

and a pusher for selectively pushing said carriers onto said accumulation track.

17. The conveyor system of claim 16 wherein said carriers include platform portions.

* * * * *